US009461367B2

(12) United States Patent
Romney et al.

(10) Patent No.: US 9,461,367 B2
(45) Date of Patent: Oct. 4, 2016

(54) CREATING LOW COST MULTI-BAND AND MULTI-FEED PASSIVE ARRAY FEED ANTENNAS AND LOW-NOISE BLOCK FEEDS

(71) Applicant: Linear Signal, Inc., Spanish Fork, UT (US)

(72) Inventors: Matthew C Romney, Alpine, UT (US); Gregory P Mockett, Spanish Fork, UT (US)

(73) Assignee: OVERHORIZON LLC, Arlington, VA (US)

( * ) Notice: Subject to any disclaimer, the term of this patent is extended or adjusted under 35 U.S.C. 154(b) by 169 days.

(21) Appl. No.: 14/162,632

(22) Filed: Jan. 23, 2014

(65) Prior Publication Data

US 2014/0203995 A1 Jul. 24, 2014

Related U.S. Application Data

(60) Provisional application No. 61/755,754, filed on Jan. 23, 2013.

(51) Int. Cl.

| | |
|---|---|
| ***H01Q 21/30*** | (2006.01) |
| ***H01Q 19/17*** | (2006.01) |
| ***H01Q 21/06*** | (2006.01) |
| ***H01Q 25/00*** | (2006.01) |
| ***H01Q 5/30*** | (2015.01) |

(52) U.S. Cl.

CPC ..... *H01Q 19/17* (2013.01); *H01Q 5/30* (2015.01); *H01Q 21/065* (2013.01); *H01Q 25/007* (2013.01)

(58) Field of Classification Search

CPC ..... H01Q 21/30

USPC ..... 343/893, 700 MS, 846; 342/70, 175

See application file for complete search history.

(56) References Cited

U.S. PATENT DOCUMENTS

| | | | | |
|---|---|---|---|---|
| 4,965,605 | A * | 10/1990 | Chang | H01Q 3/24 343/700 MS |
| 5,982,326 | A * | 11/1999 | Chow | H01Q 9/0435 342/365 |
| 2002/0126048 | A1* | 9/2002 | Zhu | H01P 1/181 343/700 MS |
| 2010/0066631 | A1* | 3/2010 | Puzella | H01Q 1/02 343/853 |
| 2010/0090902 | A1* | 4/2010 | Thompson | H01Q 1/40 343/700 MS |
| 2011/0156946 | A1* | 6/2011 | Margomenos | G01S 7/032 342/70 |
| 2012/0032847 | A1* | 2/2012 | Baktur | H01Q 1/22 342/365 |
| 2015/0015453 | A1* | 1/2015 | Puzella | H01Q 21/0025 343/853 |

* cited by examiner

*Primary Examiner* — Huedung Mancuso
(74) *Attorney, Agent, or Firm* — Kunzler Law Group

(57) ABSTRACT

An antenna, multi-band antenna system, and antenna apparatus for radio frequency communications are disclosed. The antenna includes a first antenna core, a multi-band antenna array located on the first antenna core, a second antenna core laminated to the first antenna core, an antenna ground plane located on the second core, and a plurality of feed networks interspersed on the first antenna core and the second antenna core. The first antenna core and the second antenna core form dielectric columns between the multi-band antenna array and the antenna ground plane. The antenna may also include a low noise block feed connection located on the first antenna core.

20 Claims, 6 Drawing Sheets

CREATING LOW COST MULTI-BAND AND MULTI-FEED PASSIVE ARRAY FEED ANTENNAS AND LOW-NOISE BLOCK FEEDS

CROSS-REFERENCES TO RELATED APPLICATIONS

This application claims the benefit of U.S. Provisional Patent Application No. 61/755,754 entitled "Method and Process for Creating Low Cost Multi-band and Multi-Feed Passive Array Feed Antennas and LNBFs" and filed on 23 Jan. 2013 for Matthew C. Romney, et al., which is incorporated herein by reference.

FIELD

This invention relates to multi-band antenna design and more particularly relates to low cost, multi-band, and multi-feed passive array feed antennas and low-noise block feeds.

BACKGROUND

Multi-band antenna arrays for satellite communications include 5 or more antenna cores laminated together and include 8 or more metallized layer that contain antenna elements and feed networks. Conventional multi-band antenna arrays require blind vias, counterbores, cavities, and the like which result in high fabrication costs. Accordingly, conventional multi-band antenna arrays are not economical for many commercial applications.

SUMMARY

An antenna for radio frequency communications is disclosed. The antenna includes a first antenna core, a multi-band antenna array located on the first antenna core, a second antenna core laminated to the first antenna core, an antenna ground plane located on the second core, and a plurality of feed networks interspersed on the first antenna core and the second antenna core. The first antenna core and the second antenna core form dielectric columns between the multi-band antenna array and the antenna ground plane. The antenna may also include a low noise block feed connection located on the first antenna core.

In some embodiments, the multi-band antenna array includes a first antenna array configured to operate on a first radio frequency band and a second antenna array configured to operate on a second radio frequency band. The second antenna array may be integrated into the same antenna boresite as the first antenna array. In certain embodiments, the second antenna array is oriented at a 45 degree offset to the axis of the first antenna array. In some embodiments, the multi-band antenna includes a first patch array and a second patch array having a common antenna boresite.

In some embodiments, the plurality of feed networks may include a first feed network connected to the first antenna array and a second feed network connected to the second antenna array. The second feed network may lie outside the dielectric columns associated with the first antenna array. The first feed network is located on the first antenna core and the second feed network is located on the second antenna core. The first feed network and the multi-band antenna array may be located on a common surface of the antenna. In some embodiments, the plurality of feed networks are located outside of the dielectric columns.

A multi-band antenna system for radio frequency communications is disclosed. The system includes a first antenna core having a first metallized layer, a first substrate, and a second metallized layer, a second antenna core having a third metallized layer, a second substrate, and a fourth metallized layer, wherein the second antenna core is laminated to the first antenna core with the second metallized layer adjacent to the third metallized layer, a multi-band antenna array located on the first antenna core, a dielectric column located under the multi-band antenna array, a first feed networks located on the first antenna core, a second feed network located on the second antenna core, and a low noise block downconverter integrated with the first antenna core.

In some embodiments, the multi-band antenna includes a first patch array and a second patch array having a common antenna boresite. The second feed network may lie outside dielectric columns associated with the first antenna array. The first patch array may be configured to operate on a first radio frequency band and the second patch array may be configured to operate on a second radio frequency band. In some embodiments, the first feed network is located on the first metallized layer and the second feed network is located on the fourth metallized layer.

In some embodiments, a thickness of the first substrate is configured for use with antenna electronics. The first substrate may be thinner than the second substrate. The first antenna core may be a printed circuit board and the low noise block downconverter may be attached to the printed circuit board.

An antenna apparatus for radio frequency communications is disclosed. The antenna apparatus includes an antenna array configured to operate on a first radio frequency band and a second radio frequency band, a dielectric column located under the antenna array and formed by laminating two substrates together, the substrates including a copper layer, the copper layer being removed prior to lamination to create the dielectric column, a first corporate feed network formed on a first surface of the laminated substrates and situated outside the dielectric column, a second corporate feed network formed on a second surface of the laminated substrates and situated outside the dielectric column, and a low noise block board formed on the first surface of the laminated substrates.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
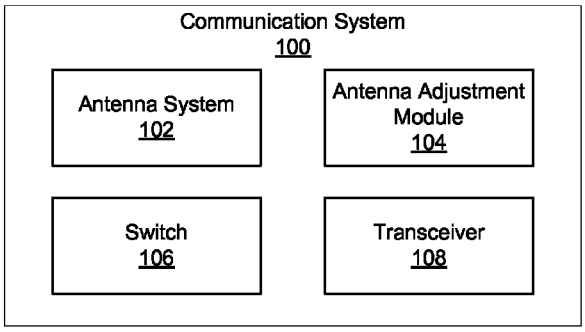
FIG. 1 is a diagram illustrating one embodiment of a communication system, in accordance with the present invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Generally, the systems, apparatus, and methods disclosed herein describe a low-cost, multi-band, multi-feed passive-array antenna. The antenna is used for radio frequency (RF) communications. In some embodiments, the antenna is used for satellite communications. In further embodiments, the antenna is used for communicating on the Ku, the Ka, and/or the RB bands. In further embodiments, the antenna is used for communicating at microwave frequencies. The antenna design minimizes fabrication costs by reducing the number of antenna cores used and by reducing the processing involved in combining the antenna cores. More specifically, the disclosed antenna minimizes blind vias, counterbores, cavities, and the like within the antenna structure.

FIG. 1 depicts a communication system 100 for radio frequency communications, according to embodiments of the disclosure. The communication system 100 includes an antenna system 102, an antenna adjustment module 104, and a transceiver 108. In some embodiments, the communication system 100 also includes a switch 106.

The antenna system 102 receives and radiates RF signals. The antenna system may include an antenna array and one or more low-noise blocks (LNBs). In some embodiments, the antenna system 102 is configured to receive and output multiple RF signals. For example, the antenna system 102 may receive signals distinguishable by frequency, polarization, and the like. In some embodiments, the antenna system 102 also includes a housing and/or a mounting structure. The antenna system 102 is discussed in further detail below with reference to FIG. 2.

In some embodiments, the antenna system 102 includes a reflector that reflects and focuses RF radiation. In further embodiments, the reflector may be a parabolic reflector that reflects incoming RF radiation traveling along the axis of the reflector such that the reflected RF radiation converges as a focal point. The parabolic reflector may also reflect RF radiation originating at the focal point into a beam along the axis of the reflector. Typically, the antenna system 102 is placed at or near the focal point of the reflector so that the reflector focuses incoming RF radiation onto the antenna system 102 and projects outgoing RF radiation. In some embodiments, the reflector may be an off-axis reflector so that the antenna system 102 does not cast a "shadow" on the reflector.

The antenna adjustment module 104 allows for adjustment of the angle, orientation, and/or position of the antenna system 102. In some embodiments, the antenna adjustment module 104 is integrated with a housing for the antenna system 102. In some embodiments, the antenna adjustment module 104 rotates the antenna system 102 about a boresite axis of the antenna system. In some embodiments, the antenna adjustment module 104 rotates the antenna system 102 at an angle relative to the boresite axis. In certain embodiments, the adjustment module 104 translates the antenna system 102. For example, the adjustment module 104 may include a slide mechanism for moving the antenna system 102 into a reflector focal point. The adjustment module may include tracks at different angles relative to the boresite axis for fine tuning the placement of the antenna system 102.

In some embodiments, the system 100 includes a switch 106. The switch may be necessary where the antenna system 102 is configured to receive multiple transmissions, the switch allowing for selection between the multiple signals. For example, where the antenna system 102 includes multiple LNBs, the antenna system 102 may output a plurality of signals and the switch 106 allows for selection between the plurality of signals. Additionally, the switch 106 may be necessary where the system 100 is used to both transmit and receive RF signals, the switch allowing for duplex communication.

The transceiver 108 receives and/or transmits RF signals. In some embodiments, the system 100 is used for microwave band RF communications and the transceiver 108 operates at base band and intermediate frequencies while the antenna module 102 converts intermediate frequencies to microwave frequencies and vice versa. When receiving, the transceiver 108 demodulates received signals to obtain data from the RF signals. When transmitting, the transceiver 108 modulates data onto carriers to produce RF signals.

Figure 2:
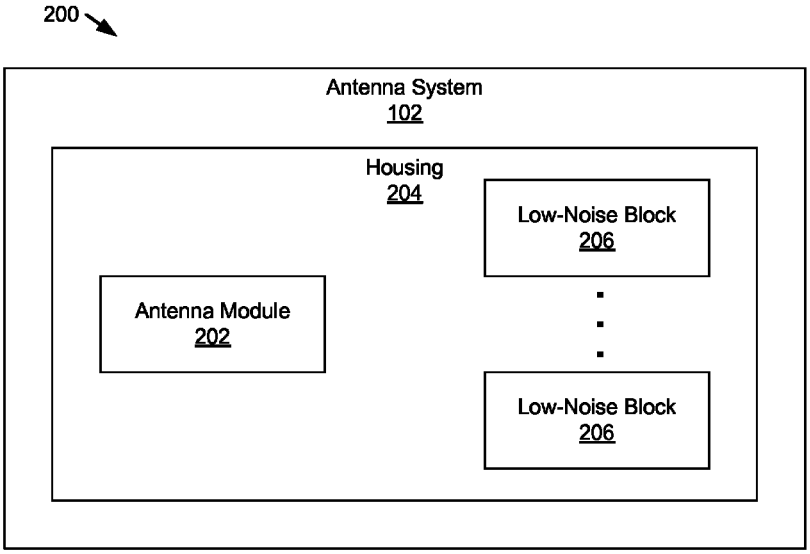
FIG. 2 is a block diagram illustrating one embodiment of an antenna system, in accordance with the present invention.

FIG. 2 is a block diagram depicting a multi-band antenna system 200 for RF communications, according to embodiments of the disclosure. The multi-band antenna system 200 contains an antenna system 102, such as the antenna system 102 described above with reference to FIG. 1. The antenna system 102 includes an antenna module 202 and one or more low-noise block downconverters (LNBs) 206. In some embodiments, the antenna system 102 also includes a housing 204.

The antenna module 202, in one embodiment, is configured to collect RF signals via one or more arrays of antenna elements and provide the RF signals to one or more LNB 206 via a feed network. In some embodiments, the antenna module 202 is configures to receive RF signals via the feed network and radiate the RF signals via the antenna elements.

In some embodiments, the antenna module includes a first antenna core and a second antenna core that are laminated together to form the antenna module 202. The first and second antenna cores may be two-sided printed circuit boards (i.e., a dielectric substrate with top and bottom metallized layers) with metal (e.g., copper) removed to form a multi-band antenna array and windows for a dielectric column. In some embodiments, the multi-band antenna array includes a first antenna array configured to operate on a first radio frequency band and a second antenna array configured to operate on a second radio frequency band. The second antenna array may have a common antenna boresite as the first antenna array. In further embodiments, the second antenna array is oriented at a 45 degree offset to the axis of the first antenna array.

Each antenna core of the antenna module 202 may have a feed network. In some embodiments, the first and second antenna cores are each thin enough to have a LNB integrated with the antenna core. In further example, the each antenna core may have a substrate thickness between 20 mils and 40 mils and the first antenna core may be the same or different thicknesses as the second antenna core.

In some embodiments, the antenna module 202 may include a single antenna core having sufficient substrate thickness to effectively transceive RF signals. The single antenna core may include a multi-band antenna array on a top face and an antenna ground plane on a bottom face. The single antenna core may further include two or more corporate feed networks including coplanar wave guides on both the top face and the bottom face, the corporate feed networks occupying the space around the antenna array. In further embodiments, the single antenna core may have a substrate thickness between 40 mils to 60 mils.

The housing 204 is configured to securely mount the antenna module 202 and the LNBs 206. In some embodiments, the housing 204 includes material transparent to RF signals. In further embodiments, the entire housing 204 is RF transparent. In some embodiments, the housing 204 holds the antenna system 102 at a reflector focal point. In some embodiments, the housing 204 protects the antenna module 202 and the LNBs 206 from exposure to the elements.

In some embodiments, the housing 204 includes an adjustment mechanism for spatially adjusting the location of the antenna module 202 and/or the LNBs 206. A dial, slide, or the like may be used to finely adjust the position of the antenna module 202 and/or LNB 206. In further embodiments, each LNB may point slightly off boresite axis or differently toward a reflector and the housing 204 may contain a back plate (or front plate) of metal or plastic or other suitable material that allows for the antenna module 202 and/or LNB 206 to be secured in a particular antenna positioning that is molded into the plate using screws, rivets, or other fastener. In some embodiments, the housing 204 includes tracks of different angles relative to the reflector or boresite axis for the antenna module 202 and/or LNBs 206. These tracks may also be used for adjustable fine tuning the point of each antenna.

Each low-noise block (LNB) 206 is configured to receive, amplify, and downconvert RF signals received by the antenna module 202. The LNB is configured to introduce a minimal amount of noise when amplifying the RF signals. The LNB 206 is further configured to convert RF signals having a high frequency, for example microwave signals, into intermediate frequency signals. The efficiency of the LNB 206 increases as the distance between the LNB 206 and the antenna module 202 decreases. For this reason, the LNB 206 is located as close to the antenna module 202 as possible. In some embodiments, the LNB 206 is formed on the same substrate as the antenna module 202.

Figure 3:
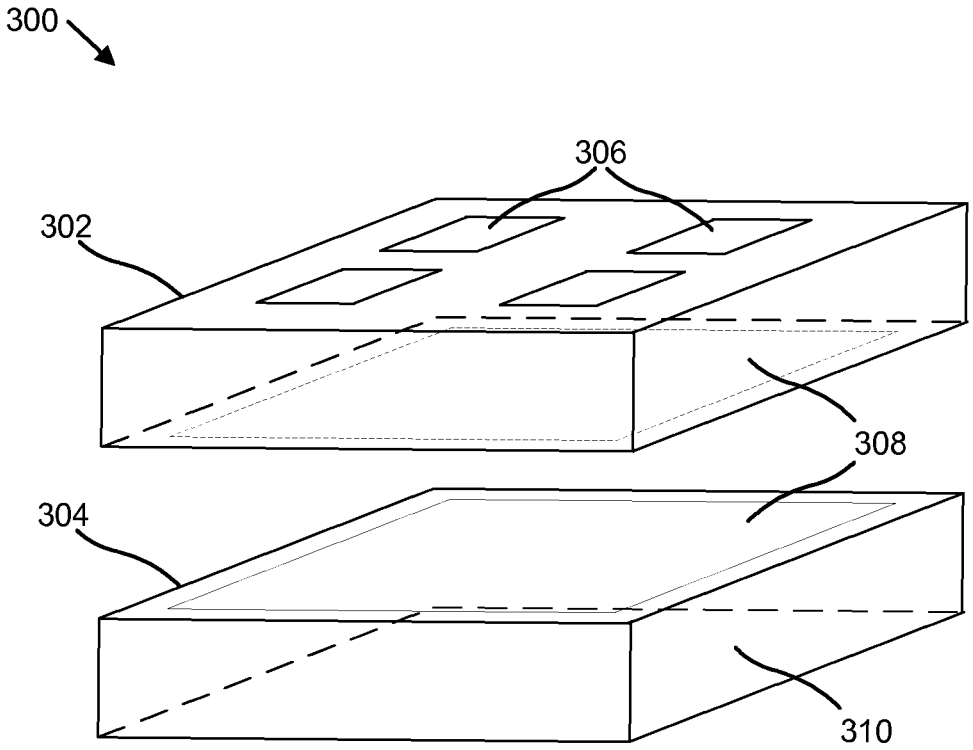
FIG. 3 is a perspective view illustrating one embodiment of an antenna apparatus, in accordance with the present invention.

FIG. 3 is a perspective view depicting one embodiment of an antenna apparatus 300 for RF communications, according to embodiments of the disclosure. The antenna apparatus 300 is similar to the antenna module 202 described above with reference to FIG. 2. The antenna apparatus 300 includes a first antenna core 302, a second antenna core 304, an antenna array 306, dielectric column windows 308, and a ground plane 310.

The first antenna core 302 includes a substrate and at least one metallized layer. For example, the first antenna core 302 may include a layer of copper on top of the substrate. In some embodiments, the first antenna core 302 includes two metallized layers—one on the top surface and another on the bottom surface of the substrate. These metallized layers are used to form, e.g., antenna elements and ground planes.

In some embodiments, the first antenna core 302 includes a feed network for the antenna array 306. In some embodiments, the first antenna core 302 includes a portion of a secondary feed network for the antenna array 306. The feed network(s) electrically connect the antenna array 306 to one or more low noise blocks (LNB).

In some embodiments, the LNB is built on the first antenna core 302 using the same substrate as the antenna array 306 to reduce fabrication costs. In other embodiments, one or more LNB connectors are formed on the first antenna core 306 to connect the antenna array 306 to a LNB built on a separate printed circuit board (PCB). In some embodiments, the connectors include ribbon or wire bonding. In some embodiments, the connectors include a ball grid array for mounting the separate LNB PCB. Using a separate PCB for the LNB allows for optimal substrate thickness of both the antenna core 303 and the LNB to improve performance.

The second antenna core 304 includes a substrate and at least one metallized layer. For example, the second antenna core 304 may include a layer of copper on top of the substrate. In some embodiments, the second antenna core 304 includes two metallized layers—one on the top surface and another on the bottom surface of the substrate. These metallized layers are used to form, e.g., antenna elements and ground planes.

In some embodiments, the second antenna core 304 includes a feed network for the antenna array 306. For example, second antenna core 304 may include a secondary feed network for the antenna array 306. The feed network(s) electrically connect the antenna array 306 to one or more low noise blocks (LNB).

In some embodiments, the LNB is built on the second antenna core 304 using the same substrate as the antenna array 306 to reduce fabrication costs. In other embodiments, one or more LNB connectors are formed on the second antenna core 304 to connect the antenna array 306 to a LNB built on a separate printed circuit board (PCB). In other embodiments, the second antenna core 304 may include one or more connections to a LNB located on (or connected to) the first antenna core 302.

The antenna array 306 is located on the first antenna core 302. In some embodiments, a feed network for the antenna array 306 is also located on the first antenna core 302. In further embodiments, the feed network for the antenna array 306 is located on the same surface of the first antenna core 302 as the antenna array 306.

In some embodiments, the antenna array 306 is a multi-band antenna array. Thus, the antenna array 306 may be capable of receiving and/or transmitting on two or more different frequency bands. In further embodiments, the antenna array 306 may include a first array configured to operate on a first RF band, and a second array configured to operate on a second RF band. The antenna array 306 is discussed in further detail, below, with reference to FIGS. 4A, 5A-5D, and 6A-6B.

The dielectric column windows 308 are formed on inner surfaces of the first antenna core 302 and the second antenna core 304. For example, portions of the bottom metallized layer of the first antenna core 302 and the top metallized layer of the second antenna core 304 may be removed to form the dielectric column windows 308. In some embodiments, the dielectric column windows 308 are a single window on each of the first antenna core 302 and the second antenna core 304 and corresponds in shape to the entire antenna array 306. In other embodiments, the dielectric column window 308 includes a plurality of sub-windows located under each element of the antenna array 306, each sub-window corresponding in shape to the antenna array element above it.

The substrate thickness of the first antenna core 302 is, typically, insufficient to form an effective antenna. Accordingly, the first antenna core 302 may be fused, or laminated, to the second antenna core 304 so that there is sufficient dielectric material between the antenna array 306 and the ground plane 310 to form an effective antenna. Prior to fusing the antenna cores 302, 304, material is removed from the metallized layers between the antenna array 306 and the ground plane 310 to form the dielectric column windows 308. After fusing, an uninterrupted column of dielectric material of sufficient thickness exists between the antenna array 306 and the ground plane 310, the dielectric column passing through the dielectric windows 308.

In some embodiments, the substrate of the first antenna core 302 has a different thickness than the substrate of the second antenna core 304. For example, the first antenna core 302 may include a substrate 20 mils thick and the second antenna core 302 may include a substrate 30 mils thick. After fusing, the antenna apparatus 300 would have an effective thickness of 50 mils, while the thinner substrate of the first antenna core 302 would allow for the LNB to be located on the first antenna core 302.

The antenna ground plane 310 is located on the bottom of the second antenna core 304. The antenna ground plane 310 reflects RF signals from the antenna array 306. In some embodiments, the antenna ground plane 310 is a continuous layer of metal to reduce fabrication costs of the antenna apparatus 300. In some embodiments, the ground plane 310 is co-located with a secondary feed network for the antenna array 306.

FIGS. 4A-4D are views depicting an antenna apparatus 400 for RF communications, according to embodiments of the disclosure. The antenna apparatus 400 may be similar to the antenna module 202 and/or the antenna apparatus 300 discussed above with reference to FIGS. 2 and 3. The antenna apparatus 400 includes a first antenna core 302 and a second antenna core 304. The first antenna core 302 includes a first metallized layer 402 and a second metallized layer 412. The second antenna core 304, in one embodiment, includes a third metallized layer 422 and a fourth metallized layer 432. In certain embodiments, the metallized layers 402, 412, 422, and 432 are thin deposits of copper upon a dielectric substrate. FIGS. 4A-4D primarily depict the copper on the first antenna cores 302 and/or the second antenna core 304.

Figure 4A:
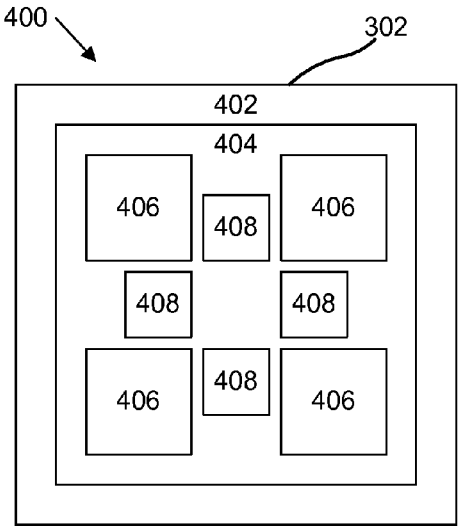
FIG. 4A is a top view illustrating one embodiment of an antenna apparatus, in accordance with the present invention.

FIG. 4A depicts the first metallized layer 402. The first metallized layer 402 is located on a top surface of the first antenna core 302. When the first antenna core 304 is fused, or laminated, to the second antenna core 304, the first metallized layer 402 is an outer surface of the laminated antenna cores. A plurality of first antenna elements 406 and a plurality of second antenna elements 408 are formed on the first metallized layer 402. The antenna elements 406 and 408 may be formed by a subtractive process, an additive process, and/or a semi-additive process. In some embodiments, a mask 404 is applied to the first metallized layer 402 to form a plurality of first antenna elements 406 and a plurality of second antenna elements 408.

In some embodiments, the first antenna elements 406 may be patch antenna elements. While shown in FIG. 4A as square, the first antenna elements 406 may be rectangular or circular according to the operating requirements of the antenna apparatus 400. In some embodiments, the second antenna elements 408 may also be patch antenna elements. While shown in FIG. 4A as square, the second antenna elements 408 may be rectangular or circular according to the operating requirements of the antenna apparatus 400.

The first antenna elements 406 form a first antenna array capable of receiving (or transmitting) RF signals in a first RF band. The second antenna elements 408 for a second antenna array capable of receiving (or transmitting) RF signals in a second RF band. As seen in FIG. 4A, the second antenna array is integrated in the same antenna boresite as the first antenna array. The size of the antenna elements 406, 408 determines the RF band the antenna elements 406, 408 operate in. In some embodiments, the first antenna elements 406 are operable in the microwave band. In further embodiments, the first antenna elements 406 are operable in the Ku band. In some embodiments, the second antenna elements 408 are operable in the microwave band. In further embodiments, the second antenna elements 408 are operable in the RB or Ka bands.

In some embodiments, the first metallized layer 402 may include one or more microstrip transmission lines (not shown). In certain embodiments, the first metallized layer 402 includes a feed network, such as a corporate feed, for the first antenna elements 406 and/or the second antenna elements 408. The feed network may be built atop the first metallized layer 402 with the second metallized layer 412 serving as a ground plane for the feed network. Where necessary, the feed network may extend into the second metallized layer 412, for example to route around intersection points or other obstacles. Any routing of the feed network onto the second metallized layer 412 would occur outside the space under the first antenna elements 406 and the second antenna elements 408.

In further embodiments, the first metallized layer may include a Low-Noise block (LNB) board. In further embodiments, the first metallized layer 402 may include electronics of the LNB or other antenna electronics. For example, the substrate of the first antenna core 402 may be sufficiently thin to serve as a printed circuit board (PCB) for antenna electronics, such as the LNB.

Figure 4B:
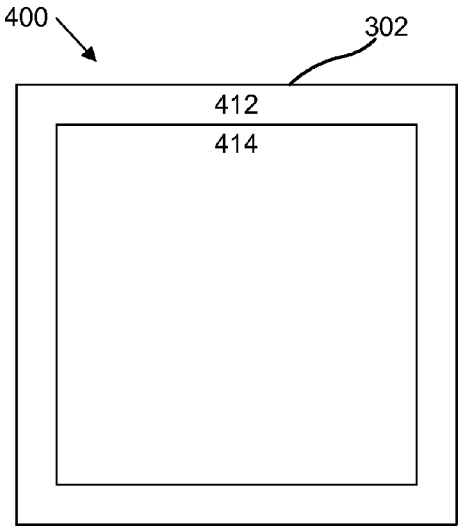
FIG. 4B is a cross-sectional view illustrating the antenna apparatus of FIG. 4A, in accordance with the present invention.

FIG. 4B depicts the second metallized layer 412. The second metallized layer 412 is located on a bottom surface of the first antenna core 302. When the first antenna core 302 is fused, or laminated, to the second antenna core 304, the second metallized layer 412 becomes adjacent to the second antenna core 304.

The second metallized layer 412 includes a first dielectric window 414. The first dielectric window 414 is located under the first antenna elements 406 and the second antenna elements 408. In certain embodiments, the first dielectric column window 414 is formed by removing metal from the second metallized layer 412. In some embodiments, the length and width of the first dielectric window 414 correspond to the length and width of the portion 404 removed from the first metallized layer 402. In other embodiments, the first dielectric window 414 includes a plurality of sub-windows, each sub-window located under a first antenna element 406 or a second antenna element 406 and having dimensions corresponding to the dimension of the first antenna element 406 or second antenna element 406. The first dielectric window 414 allows for the formation of dielectric columns under the first antenna elements 406 and the second antenna elements 408. Matching dielectric windows on the first antenna core 302 and the second antenna core 304 allow for the separate antenna core substrates to combine into a larger (thicker) dielectric layer needed for the antenna apparatus 400 to effectively receive and/or transmit on the desired RF frequencies.

In some embodiments, the second metallized layer 412 includes microstrip transmission lines. For example, the second metallized layer 412 may include portion of a feed network, such as a corporate feed, for the first antenna elements 406 and/or the second antenna elements 408. The feed network may extend into the second metallized layer 412, for example to route around intersection points or other obstacles. Any routing of the feed network onto the second metallized layer 412 would occur outside the space under the first antenna elements 406 and the second antenna elements 408.

Figure 4C:
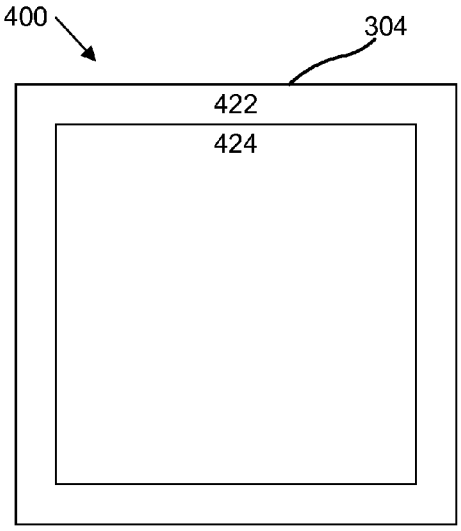
FIG. 4C is another cross-sectional view illustrating the antenna apparatus of FIG. 4A, in accordance with the present invention.

FIG. 4C depicts the third metallized layer 422. The third metallized layer 422 is located on a top surface of the second antenna core 304. When the first antenna core 302 is fused, or laminated, to the second antenna core 304, the third metallized layer 422 becomes adjacent to the first antenna core 302.

The third metallized layer 422 includes a second dielectric window 424. Like, the first dielectric window 414, the second dielectric window 424 is located under the first antenna elements 406 and the second antenna elements 408. In certain embodiments, the second dielectric column window 424 is formed by removing metal from the third metallized layer 422. The length and width of the second dielectric window 424 match the dimensions of the first dielectric window 414. In some embodiments, the length and width of the second dielectric window 424 correspond to the length and width of the portion 404 removed from the first metallized layer 402. In other embodiments, the second dielectric window 424 includes a plurality of sub-windows, each sub-window located under a first antenna element 406 or a second antenna element 406 and having dimensions corresponding to the dimension of the first antenna element 406 or second antenna element 406. The second dielectric window 424 allows for the formation of dielectric columns under the first antenna elements 406 and the second antenna elements 408. Matching dielectric windows on the first antenna core 302 and the second antenna core 304 allow for the separate antenna core substrates to combine into a larger (thicker) dielectric layer needed for the antenna apparatus 400 to effectively receive and/or transmit on the desired RF frequencies.

In some embodiments, the third metallized layer 422 includes microstrip transmission lines. For example, the third metallized layer 422 may include portion of a feed network, such as a corporate feed, for the first antenna elements 406 and/or the second antenna elements 408. The feed network may extend into the third metallized layer 422, for example to route around intersection points or other obstacles. Any routing of the feed network onto the third metallized layer 422 would occur outside the space under the first antenna elements 406 and the second antenna elements 408.

Figure 4D:
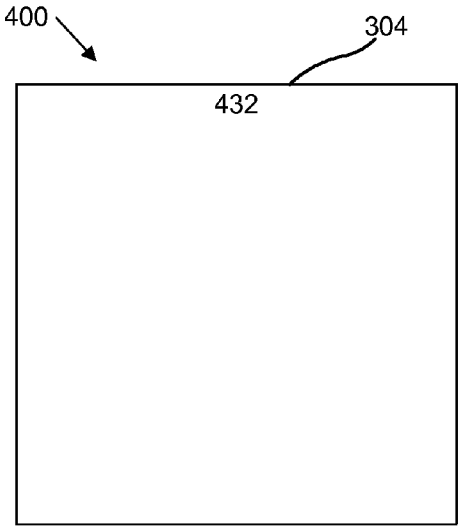
FIG. 4D is a bottom view illustrating the antenna apparatus of FIG. 4A, in accordance with the present invention.

FIG. 4D depicts the fourth metallized layer 432. The fourth metallized layer 432 is located on a bottom surface of the second antenna core 304. When the first antenna core 304 is fused, or laminated, to the second antenna core 304, the fourth metallized layer 432 is an outer surface of the laminated antenna cores. The fourth metallized layer 432 functions as a ground plane for the antenna and reflects RF signals from the first antenna elements 406 and second antenna elements 408. In some embodiments, the fourth metallized layer 432 is a continuous layer of metal to reduce fabrication costs of the antenna apparatus 400.

In some embodiments, the fourth metallized layer 432 may include one or more microstrip transmission lines (not shown). In certain embodiments, the fourth metallized layer 432 includes a feed network, such as a corporate feed, for the first antenna elements 406 and/or the second antenna elements 408. The feed network may be built atop the fourth metallized layer 432 with the third metallized layer 422 serving as a ground plane for the feed network. Where necessary, the feed network may extend into the third metallized layer 422, for example to route around intersection points or other obstacles. Any routing of the feed network onto the third metallized layer 422 would occur outside the space under the first antenna elements 406 and the second antenna elements 408.

FIGS. 5A-5D are views depicting an antenna apparatus 500 for RF communications, according to embodiments of the disclosure. The antenna apparatus 500 may be similar to the antenna module 202, the antenna apparatus 300, and/or the antenna apparatus 400 discussed above with reference to FIGS. 2, 3, and 4A-4D. The antenna apparatus 500 includes a first antenna core 302 and a second antenna core 304. The first antenna core includes a plurality of first antenna elements 406 and a plurality of second antenna elements 408. The second antenna core 304 includes a ground plane for the first antenna elements 406 and the second antenna elements 408. The first antenna core 302 may include a first metallized layer and a second metallized layer. The second antenna core 304 may include a third metallized layer and a fourth metallized layer. In certain embodiments, the metallized layers are deposits of copper upon a dielectric substrate. In other embodiments, the metallized layers are sheets of copper (or other conductive metal) laminated to the non-conductive substrate of the antenna core. FIGS. 5A-5D primarily depict corporate feed networks on the first antenna cores 302 and/or the second antenna core 304.

Figure 5A:
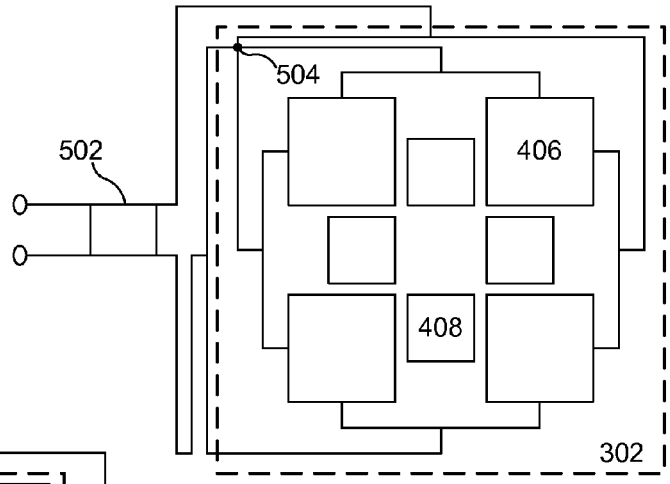
FIG. 5A is a top view illustrating one embodiment of an antenna apparatus, in accordance with the present invention.

FIG. 5A depicts one embodiment of a first corporate feed network 502 located on the first antenna core 302. More specifically, the first corporate feed network 502 may be located on the first metallized layer of the first antenna core with the second metallized layer acting as a ground plane for the first corporate feed network 502. The first corporate feed network 502 attaches to the first antenna elements 406 and relays RF signals between the first antenna elements 406 and a LNB. In some embodiments, the first corporate feed network 502 is a microstrip feed structure.

As depicted, in some embodiments, multiple feed lines in the first corporate feed network 502 attach to a first antenna element 406. The multiple feed points allows the first antenna element 406 to have polarization diversity and radiate (or receive) vertical, horizontal, right hand circular, and left hand circular polarizations. Different RF signals may have different polarizations and the multiple feed points of the first corporate feed network 502 allows for signal differentiation based on polarity.

In some embodiments, the first corporate feed network 502 may have one or more points of intersection 504. The points of intersection 504 may be routed around in the second metallized layer of the first antenna core 302. In some embodiments, the entire first corporate feed network 502 is located outside the dielectric columns underneath the first antenna elements 406 and the second antenna elements 408.

Figure 5B:
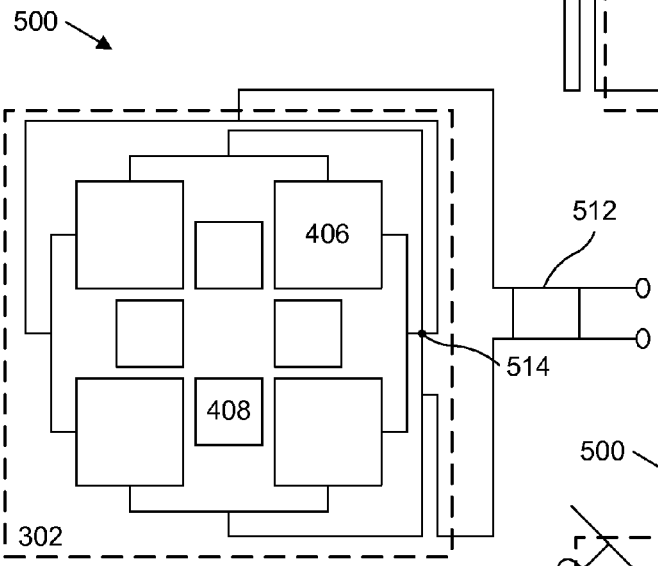
FIG. 5B is a top view illustrating another embodiment of an antenna apparatus, in accordance with the present invention.

FIG. 5B depicts one embodiment of a second corporate feed network 512 located on the first antenna core 302. The second corporate feed network 512 may also be located on the first metallized layer of the first antenna core with the second metallized layer acting as a ground plane. The second corporate feed network 512 attaches to the first antenna elements 406 and relays RF signals between the first antenna elements 406 and a LNB. The second corporate feed network 512 is an alternative feed network to the first corporate feed network 502.

As depicted, in some embodiments, multiple feed lines in the second corporate feed network 512 attach to a first antenna element 406 allowing for polarization diversity. Different RF signals may have different polarizations and the multiple feed points of the second corporate feed network 512 allows for signal differentiation based on polarity. In some embodiments, the second corporate feed network 512 is a microstrip feed structure.

In some embodiments, the second corporate feed network 512 may have one or more points of intersection 514. The points of intersection 514 may be routed around in the second metallized layer of the first antenna core 302. In some embodiments, the entire second corporate feed network 512 is located outside the dielectric columns underneath the first antenna elements 406 and the second antenna elements 408.

Figure 5C:
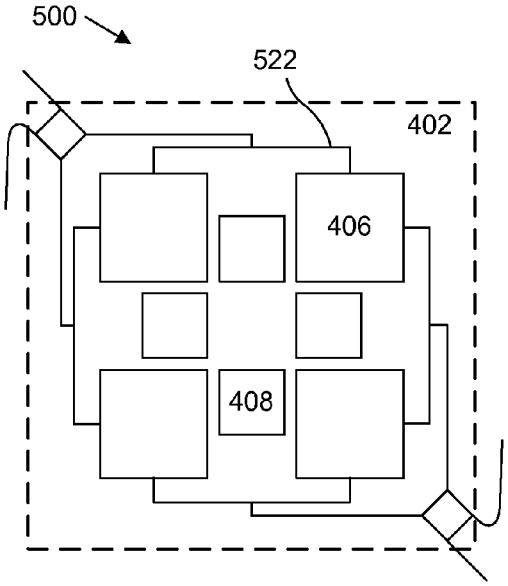
FIG. 5C is a top view illustrating another embodiment of an antenna apparatus, in accordance with the present invention.

FIG. 5C depicts one embodiment of a third corporate feed network 522 located on the first antenna core 302. The third corporate feed network 522 may also be located on the first metallized layer of the first antenna core with the second metallized layer acting as a ground plane. The third corporate feed network 522 attaches to the first antenna elements 406 and relays RF signals between the first antenna elements 406 and a LNB. The third corporate feed network 522 is an alternative feed network to the first corporate feed network 502 and the second corporate feed network 512.

As depicted, in some embodiments, multiple feed lines in the third corporate feed network 522 attach to a first antenna element 406 allowing for polarization diversity. Different RF signals may have different polarizations and the multiple feed points of the third corporate feed network 522 allows for signal differentiation based on polarity. In some embodiments, the third corporate feed network 522 may include a microstrip feed structure.

The third corporate feed network 522 is designed to avoid any points of intersection. By avoiding routing around in the second metallized layer, fabrication costs may be reduced as compared to the first corporate feed network 502 or the second corporate feed network 512.

Figure 5D:
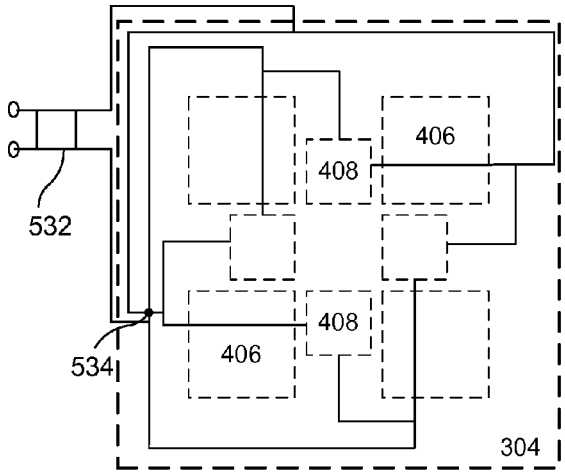
FIG. 5D is a bottom view illustrating another embodiment of an antenna apparatus, in accordance with the present invention.

FIG. 5D depicts one embodiment of a fourth corporate feed network 532 located on the second antenna core 304. More specifically, the fourth corporate feed network 532 may be located on the fourth metallized layer of the second antenna core 304 with the third metallized layer acting as a ground plane for the fourth corporate feed network 532. The fourth corporate feed network 532 attaches to the second antenna elements 408 and relays RF signals between the second antenna elements 408 and a LNB. In some embodiments, fourth corporate feed network 532 is a microstrip feed structure.

As depicted, in some embodiments, multiple feed lines in the fourth corporate feed network 532 attach to one of the second antenna elements 408. The multiple feed points allows the second antenna element 408 to have polarization diversity and radiate (or receive) vertical, horizontal, right hand circular, and left hand circular polarizations. Different RF signals may have different polarizations and the multiple feed points of the fourth corporate feed network 532 allows for signal differentiation based on polarity.

In some embodiments, the fourth corporate feed network 532 may have one or more points of intersection 534. The points of intersection 534 may be routed around in the third metallized layer of the second antenna core 304. In some embodiments, the entire fourth corporate feed network 532 is located outside the dielectric columns underneath the first antenna elements 406 and the second antenna elements 408.

Figure 6A:
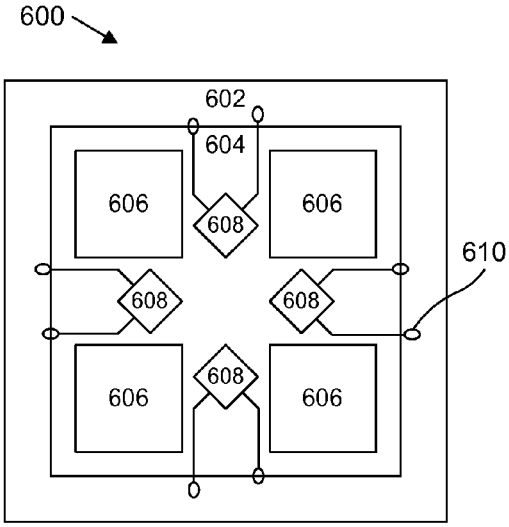
FIG. 6A is a top view illustrating another embodiment of an antenna apparatus, in accordance with the present invention.
Figure 6B:
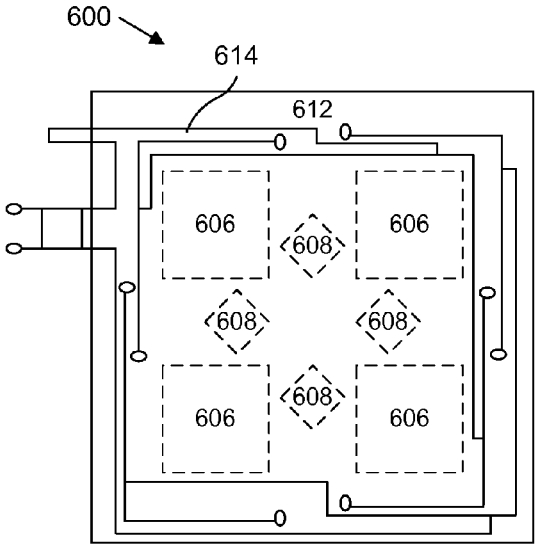
FIG. 6B is a bottom view illustrating another embodiment of an antenna apparatus, in accordance with the present invention.

FIGS. 6A-6B are views depicting an antenna apparatus 600 for RF communications, according to embodiments of the disclosure. The antenna apparatus 600 may be similar to the antenna module 202, the antenna apparatus 300, the antenna apparatus 400, and/or the antenna apparatus 500 discussed above with reference to FIGS. 2, 3, 4A-4D, and 5A-5D. The antenna apparatus 600 includes an upper antenna core 602 and a lower antenna core 604. The upper antenna core 602 and the lower antenna core 604 may be substantially similar to the first antenna core 302 and the second antenna core 304, respectively, as discussed above reference to FIGS. 2, 3, 4A-4D, and 5A-5D. The upper antenna core 602 includes a first antenna array 606, a second antenna array 608, and an upper feed network 610. The lower antenna core 604 includes a lower feed network 612.

The upper antenna core 602 includes a dielectric substrate and at least one metallized layer upon which the first antenna array 606 and the second antenna array 608 are formed. In some embodiments, the upper antenna core 602 includes a second metallized layer on an opposite side of the dielectric substrate from the antenna arrays 606 and 608. The second metallized layer functions as a ground plane for the upper feed network 610.

The lower antenna core 604 includes a dielectric substrate and at least one metallized layer upon which an antenna ground plane and the lower feed network 612 are formed. In some embodiments, the upper antenna core 602 includes a second metallized layer on an opposite side of the dielectric substrate from the lower feed network 612 that functions as a ground plane for the lower feed network 612.

The first antenna array 606 consists of a plurality of antenna elements and is capable of receiving (or transmitting) RF signals in a first RF band. In some embodiments, the first antenna array 606 consists of patch antenna elements. While shown in FIG. 6A as square, the antenna elements may be rectangular or circular according to the operating requirements of the antenna apparatus 600. One or more dielectric columns exist between the first antenna array 606 and an antenna ground plane on the lower antenna core 604.

The size of the antenna elements in the first antenna array 606 determines which RF band the first antenna array 606 operates in. In some embodiments, the first antenna array 606 is operable in the microwave band. In further embodiments, the first antenna array 606 is operable in the Ku band.

The second antenna array 608 consists of a plurality of antenna elements and is capable of receiving (or transmitting) RF signals in a second RF band. The second antenna array 608 is integrated into the same antenna boresite as the first antenna array 606. Further, the second antenna array 608 may be rotated with respect to the first antenna array 606. As shown in FIG. 6A, the second antenna array is oriented at a 45 degree offset to the axis of the first antenna array 606.

In some embodiments, the second antenna array 606 consists of patch antenna elements. While shown in FIG. 6A as square, the elements of the second antenna array may be rectangular or circular according to the operating requirements of the antenna apparatus 600. Additionally, the size of the elements of the second antenna array 608 is determined according to the operating requirements of the antenna apparatus 600. In some embodiments, the second antenna array 608 is operable in the microwave band. In further embodiments, the second antenna array 608 is operable in the RB or Ka bands.

The upper feed network 610 attaches to the second antenna array 608 and relays RF signals between the second antenna array 608 and the lower feed network 612. The upper feed network 610 may be formed on the same metallized layer as the antenna arrays 606 and 608. In some embodiments, the upper feed network 610 is a microstrip feed structure. As depicted in FIG. 6A, in some embodiments, multiple feed lines in the upper feed network 610 attach to each of the elements of the second antenna array 608. The multiple feed lines allow the antenna element to have polarization diversity and radiate (or receive) vertical, horizontal, right hand circular, and left hand circular polarizations. Different RF signals may have different polarizations and the multiple feed points of the upper feed network 610 allows for signal differentiation based on polarity.

The upper feed network 610 is designed to avoid passing through any dielectric columns of the first antenna array 606. The upper feed network extends beyond the first and second antenna arrays 606, 608 and connects to the lower feed network 612. The upper feed network 610 and the lower feed network 612 form the corporate feed network for the second antenna array 608. Although not shown in FIGS. 6A-6B, the first antenna array 606 may be connected to a corporate feed network such as those depicted in FIGS. 5A-5C.

The lower feed network 612 attaches to the upper feed network 610 and relays RF signals between the upper feed network 610 and a LNB. In some embodiments, portions of the LNB are located on the lower antenna core 604. The lower feed network 612 may be formed on the same metallized layer as the antenna ground plane. In some embodiments, the lower feed network 612 is a microstrip feed structure.

The arrangement of the upper feed network 610 and the lower feed network 612 allows the corporate feed network for the second antenna array 608 to avoid passing through any dielectric columns of the first antenna array 606 or of the second antenna array 608. Accordingly, RF signals may be received simultaneously by the first antenna array 606 and the second antenna array 608 with minimal interference from the feed networks.

Figure 7:
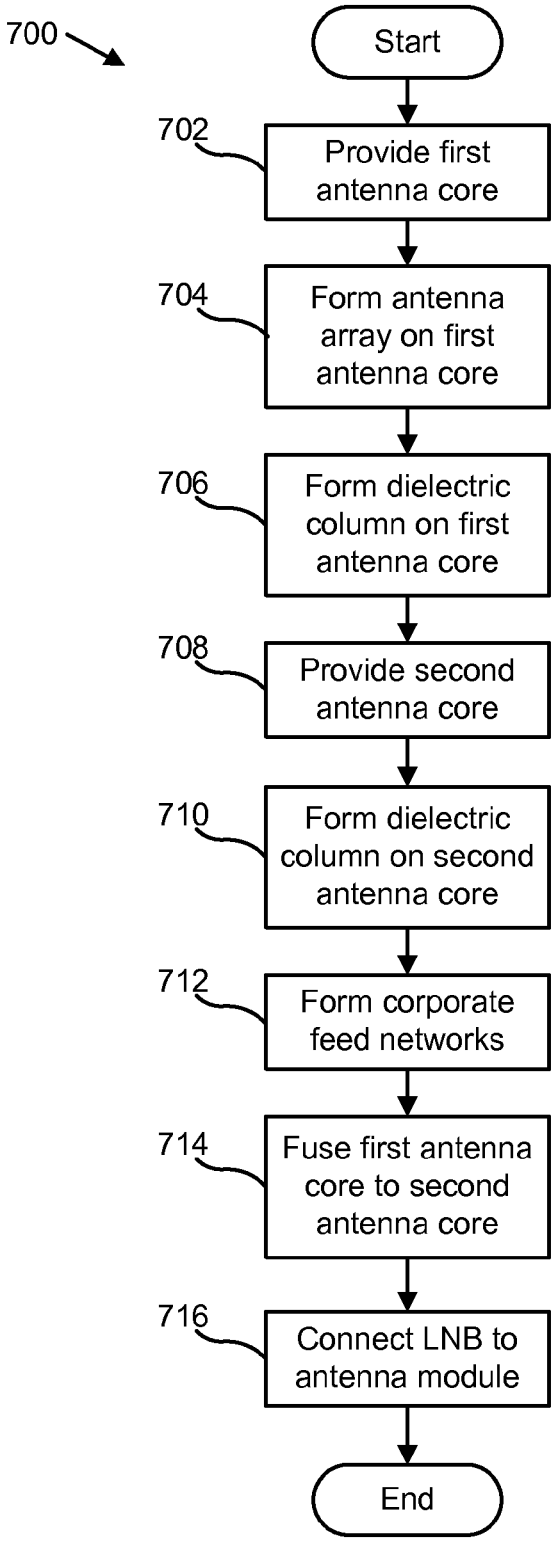
FIG. 7 is a flow chart diagram illustrating one embodiment of a method for producing an antenna apparatus in accordance with the present invention.

FIG. 7 is a flow chart diagram depicting a method 700 for producing an antenna system for RF communications, according to embodiments of the disclosure. In some embodiments, the method 700 produces an antenna apparatus, such as the antenna apparatus 300, 400, 500, and/or 600, as described above with reference to FIGS. 3, 4A-4D, 5A-5D, and 6A-6B.

The method 700 begins by producing 702 a first antenna core. The first antenna core may be similar to the first antenna core 302 or to the upper antenna core 602 discussed above with reference to FIGS. 3, 4A-4D, 5A-5D, and 6A-6B. In some embodiments, the first antenna core is a printed circuit board (PCB).

Next, an antenna array is formed 704 on the first antenna core. The antenna array may be a multi-band antenna array with a first set of antenna elements designed to operate in a first RF band and a second set of antenna elements designed to operate in a second RF band. The antenna array may be substantially similar to the antenna array 306, the first antenna elements 406, the second antenna elements 408, the first antenna array 606 and/or the second antenna array 608 described above with reference to FIGS. 3, 4A-4D, 5A-5D, and 6A-6B. The antenna array may be formed 704 by a subtractive process, by an additive process, or by a semi-additive process.

One or more dielectric window may be formed 706 on the first antenna core under the antenna array. The dielectric window(s) allow for the later formation of dielectric columns between the antenna array and an antenna ground plane. Where the first antenna core is a two-sided PCB (i.e., with metallized layers on both sides of the substrate), the dielectric window(s) may be formed 706 by removing copper, or other conductive material, from regions opposite the antenna array. In some embodiments, a single dielectric window is formed that encompasses the entire antenna array. In other embodiments, a plurality of dielectric windows are formed, each dielectric window corresponding in shape to an antenna element of the antenna array and located opposite the antenna element.

Next, a second antenna core is produced 708. The second antenna core includes an antenna ground plane and may be similar to the second antenna core 304 or to the lower antenna core 604 discussed above with reference to FIGS. 3, 4A-4D, 5A-5D, and 6A-6B. In some embodiments, the second antenna core is a printed circuit board (PCB).

One or more dielectric windows may be formed 710 on the second antenna core under the antenna array. The dielectric window(s) allow for the later formation of dielectric columns between the antenna array and an antenna ground plane. Where the second antenna core is a two-sided PCB (i.e., with metallized layers on both sides of the substrate), the dielectric window(s) may be formed 710 by removing copper, or other conductive material, from regions opposite the antenna array. The dielectric window(s) of the second antenna core may correspond in number, shape, and location to the dielectric window(s) of the first antenna cores. In some embodiments, a single dielectric window is formed that encompasses the entire antenna array. In other embodiments, a plurality of dielectric windows are formed, each dielectric window corresponding in shape to an antenna element of the antenna array and located opposite the antenna element.

Corporate feed networks are formed 712 on the first antenna core and/or the second antenna core. Where the antenna array is a multi-band antenna array, a corporate feed network may be formed for each band the antenna operates in. Examples of corporate feed networks are described above with reference to FIGS. 3, 4A-4D, 5A-5D, and 6A-6B. In some embodiments, the corporate feed networks lie outside the dielectric columns underneath the antenna array.

Next, the first antenna core is fused 714 (or laminated) to the second antenna core to form an antenna module. The first antenna core and the second antenna core are positioned so that the dielectric windows align to form dielectric columns beneath the antenna array. The first antenna core and the second antenna core may also be positioned so that corresponding feed networks on the first antenna core and the second antenna core align.

Next, one or more low-noise blocks (LNB) are connected 716 to the antenna module. The LNBs provide preliminary signal processing by amplifying, filtering, and downconverting RF signals received by the antenna array. The LNB(s) connect 716 to the antenna array via the corporate feed networks. The method ends.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An antenna comprising:

a first antenna core;

a multi-band antenna array located on a top surface the first antenna core;

a second antenna core laminated to the first antenna core, wherein an inner surface of the first antenna core is adjacent to an inner surface of the second antenna core;

an antenna ground plane located on the second core;

a first dielectric window located at the inner surface of the first antenna core and positioned beneath the multi-band antenna array;

a second dielectric window located in the inner surface of the second antenna core and positioned beneath the multi-band antenna array, wherein the first dielectric window and the second dielectric window form a dielectric column between the multi-band antenna array and the antenna ground plane; and a plurality of feed networks interspersed on the first antenna core and the second antenna core.

2. The antenna of claim 1, further comprising a low noise block feed connection located on the first antenna core.

3. The antenna of claim 1, wherein the multi-band antenna comprises:

a first antenna array configured to operate on a first radio frequency band; and a second antenna array configured to operate on a second radio frequency band, wherein the second antenna array is integrated into the same antenna boresite as the first antenna array.

4. The antenna of claim 3, wherein the second antenna array is oriented at a 45 degree offset to the axis of the first antenna array.

5. The antenna of claim 1, wherein the plurality of feed networks comprises:

a first feed network connected to a first antenna array; and a second feed network connected to a second antenna array.

6. The antenna of claim 5, wherein the second feed network lies outside the dielectric columns associated with the first antenna array.

7. The antenna of claim 5, wherein the first feed network is located on the first antenna core and the second feed network is located on the second antenna core.

8. The antenna of claim 5, wherein the first feed network and the multi-band antenna array are located on a common surface of the antenna.

9. The antenna of claim 1, wherein the multi-band antenna comprises a first patch array and a second patch array having a common antenna boresite.

10. The antenna of claim 1, wherein the plurality of feed networks are located outside of the dielectric columns.

11. A multi-band antenna system, the system comprising:

a first antenna core comprising a first metallized layer, a first substrate, and a second metallized layer;

a second antenna core comprising a third metallized layer, a second substrate, and a fourth metallized layer, wherein the second antenna core is laminated to the first antenna core with the second metallized layer adjacent to the third metallized layer;

a multi-band antenna array located on the first antenna core and formed from the first metallized layer;

a first dielectric window located in the second metalized layer and positioned beneath the multi-band antenna array;

a second dielectric window located in the third metalized layer and positioned beneath the multi-band antenna array, wherein the first dielectric window and second dielectric window form a dielectric column between the multi-band antenna array and the fourth metallized layer;

a first feed networks located on the first antenna core;

a second feed network located on the second antenna core; and a low noise block downconverter integrated with the first antenna core.

12. The system of claim 11, wherein the multi-band antenna array comprises a first patch array and a second patch array having a common antenna boresite.

13. The system of claim 12, wherein the second feed network lies outside dielectric columns associated with the first antenna array.

14. The system of claim 12, wherein the first patch array is configured to operate on a first radio frequency band and the second patch array is configured to operate on a second radio frequency band.

15. The system of claim 11, wherein a thickness of the first substrate is configured for use with antenna electronics.

16. The system of claim 11, wherein the first feed network is located on the first metallized layer and the second feed network is located on the fourth metallized layer.

17. The system of claim 11, wherein the first antenna core is a printed circuit board and the low noise block downconverter is attached to the printed circuit board.

18. The system of claim 11, wherein the first substrate is thinner than the second substrate.

19. An antenna apparatus comprising:

an antenna array configured to operate on a first radio frequency band and a second radio frequency band;

a dielectric column located under the antenna array and formed by laminating two substrates together, the substrates comprising a copper layer, and removing a dielectric window from each copper layer prior to lamination to create the dielectric column, the antenna array being located at an outer surface of the laminated substrates;

a ground plane located on a surface of the laminated substrates opposite the antenna array, the dielectric column being formed between the antenna array and the ground plane;

a first corporate feed network formed on a first surface of the laminated substrates and situated outside the dielectric column;

a second corporate feed network formed on a second surface of the laminated substrates and situated outside the dielectric column; and a low noise block board formed on the first surface of the laminated substrates.

20. The apparatus of claim 19, wherein the antenna array comprises a first patch array and a second patch array having a common antenna boresite, the second patch array being oriented at a 45 degree offset to the first patch array.

* * * * *